US008376539B2

(12) United States Patent
Hara

(10) Patent No.: US 8,376,539 B2
(45) Date of Patent: Feb. 19, 2013

(54) LIQUID EJECTING HEAD AND LIQUID EJECTING APPARATUS

(75) Inventor: Keiji Hara, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 129 days.

(21) Appl. No.: 13/075,148

(22) Filed: Mar. 29, 2011

(65) Prior Publication Data

US 2011/0242239 A1 Oct. 6, 2011

(30) Foreign Application Priority Data

Mar. 30, 2010 (JP) ..... 2010-079888

(51) Int. Cl.
*B41J 2/175* (2006.01)

(52) U.S. Cl. ..... 347/93; 347/84

(58) Field of Classification Search ..... None
See application file for complete search history.

(56) References Cited

U.S. PATENT DOCUMENTS

| | | | | |
|---|---|---|---|---|
| 6,019,465 | A * | 2/2000 | Shinada et al. | 347/93 |
| 2005/0068379 | A1 * | 3/2005 | Sanada | 347/70 |
| 2008/0291254 | A1 * | 11/2008 | Kyoso | 347/92 |
| 2009/0009576 | A1 * | 1/2009 | Silverbrook et al. | 347/93 |

FOREIGN PATENT DOCUMENTS

| | | | |
|---|---|---|---|
| JP | 2007-210124 | A | 8/2007 |
| JP | 2007210124 | A * | 8/2007 |

* cited by examiner

*Primary Examiner* — Matthew Luu
*Assistant Examiner* — Michael Konczal
(74) *Attorney, Agent, or Firm* — Kilpatrick Townsend & Stockton LLP

(57) ABSTRACT

A liquid ejecting head includes a liquid supply member including a flow channel formation member in which flow channel groove portions having different lengths is formed each, a flexible member that seals an opening of each of the flow channel groove portions to form a liquid flow channel, a pressure reception portion formation plate that has an opening formed for each of the liquid flow channels, each of the openings overlapping the corresponding liquid flow channel formed, and valves each urged by a coil spring to close the corresponding liquid flow channel, the valve opening the channel against an urging force of the spring due to the positional change of a pressure reception portion as pressure inside the liquid flow channel changes, wherein the openings of the pressure reception portion formation plate have a uniform shape.

3 Claims, 7 Drawing Sheets

LIQUID EJECTING HEAD AND LIQUID EJECTING APPARATUS

CROSS REFERENCES TO RELATED APPLICATIONS

The entire disclosure of Japanese Patent Application No. 2010-79888, filed Mar. 30, 2010 is expressly incorporated herein by reference.

BACKGROUND OF THE INVENTION

1. Technical Field

The present invention relates to a liquid ejecting head that ejects liquid and a liquid ejecting apparatus. In particular, the invention relates to an ink-jet recording head that ejects ink and an ink-jet recording apparatus.

2. Related Art

Some recording apparatus includes an ink supply member that has a liquid flow channel, which is the flow channel of ink supplied from an ink container such as an ink cartridge to a recording head. Besides the liquid flow channel, the ink supply member includes, for example, a pressure adjusting means. The pressure adjusting means adjusts the pressure of ink supplied to the recording head to ensure that it is within a predetermined range. An example of such a pressure adjusting means is disclosed in JP-A-2007-210124. The pressure adjusting means disclosed therein includes a pressure reception portion, an actuation lever, and a valve member. The pressure reception portion is made of a flexible material as a part of the wall surface of the liquid flow channel. The position of the pressure reception portion changes due to elasticity as the internal pressure of the liquid flow channel changes. In the process of its elastic deformation, the pressure reception portion applies a pressing force to the actuation lever. The valve opens and closes as a result of the operation of the actuation lever.

In the recording head disclosed in JP-A-2007-210124, a part of the wall surface of the liquid flow channel is formed as the pressure reception portion that is made of a flexible material. Therefore, the shape of the pressure reception portion is determined depending on the shape of the liquid flow channel. For this reason, if a plurality of liquid flow channels having different lengths is formed in the ink supply member, and if a part of the wall surface of each of the plurality of liquid flow channels is formed as a pressure reception portion, it follows that the shapes of the pressure reception portions differ from one liquid flow channel to another. Since the shapes of the pressure reception portions differ from one liquid flow channel to another, the amount of a change in the position of the pressure reception portion that is caused by the change in the internal pressure of the liquid flow channel also differs from one liquid flow channel to another, which results in variation in the degree of the opening and closing of the valve from one liquid flow channel to another. Consequently, since the pressure levels of ink supplied to the recording head differ from one liquid flow channel to another, there is a risk of poor printing.

On the other hand, if the liquid flow channels have to be formed in such a manner that the pressure reception portions have a uniform shape, the freedom of design of the liquid flow channels is sacrificed. For example, in a structure in which filter chambers that are in fluid communication with liquid flow channels are arranged in a matrix for the purpose of reducing the size of a member in which flow channels inclusive of the filter chambers are formed, it is inevitable that the length of a certain liquid flow channel that is in fluid communication with a certain filter chamber that belongs to a certain row is not the same as the length of another liquid flow channel that is in fluid communication with another filter chamber that belongs to another row. For this reason, it is practically difficult to design each of the liquid flow channels in such a manner that the pressure reception portions have a uniform shape.

SUMMARY

A liquid ejecting head according to a first aspect of the invention includes: a liquid ejecting head body that ejects liquid from a nozzle orifice; and a liquid supply member that supplies liquid from a liquid supply source that contains the liquid to the liquid ejecting head body, the liquid supply member including a filter chamber group that is made up of a plurality of filter chambers arranged in one direction, a filter being provided inside each of the filter chambers, each of the filter chambers being in fluid communication with the nozzle orifice, a flow channel formation member in which a plurality of flow channel groove portions is formed, each of the flow channel groove portions being in fluid communication with the corresponding one of the filter chambers of the filter chamber group, the flow channel groove portions having different lengths, a flexible member that seals an opening of each of the flow channel groove portions to form a liquid flow channel, a pressure reception portion formation plate that has an opening formed for each of the liquid flow channels, each of the openings overlapping the corresponding one of the liquid flow channels formed in the flow channel formation member with the flexible member sandwiched between the pressure reception portion formation plate and the flow channel formation member to form a pressure reception portion, which is a part of the flexible member that is exposed at an area of each of the openings, and valve members each of which is urged by an urging member to close the corresponding one of the liquid flow channels, the valve member opening the liquid flow channel against an urging force applied by the urging member as a result of a change in position of the pressure reception portion on the basis of a pressure change inside the liquid flow channel, wherein the openings of the pressure reception portion formation plate have a uniform shape.

A liquid ejecting apparatus according to a second aspect of the invention includes a liquid ejecting head according to the first aspect of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Exemplary embodiments of the present invention will now be explained. First of all, with reference to a schematic diagram, the overall structure of an ink-jet recording apparatus, which is an example of a liquid ejecting apparatus, will be explained. The terms "from-back-to-front" direction (or "from-front-to-back" direction when viewed in the reverse orientation), "horizontal direction", and "vertical direction" that appear in the following description of this specification mean the forward/backward (front/back) direction, the leftward/rightward (left/right) direction, and the upward/downward (top/bottom) direction shown by arrows in FIG. 1.

Figure 1:
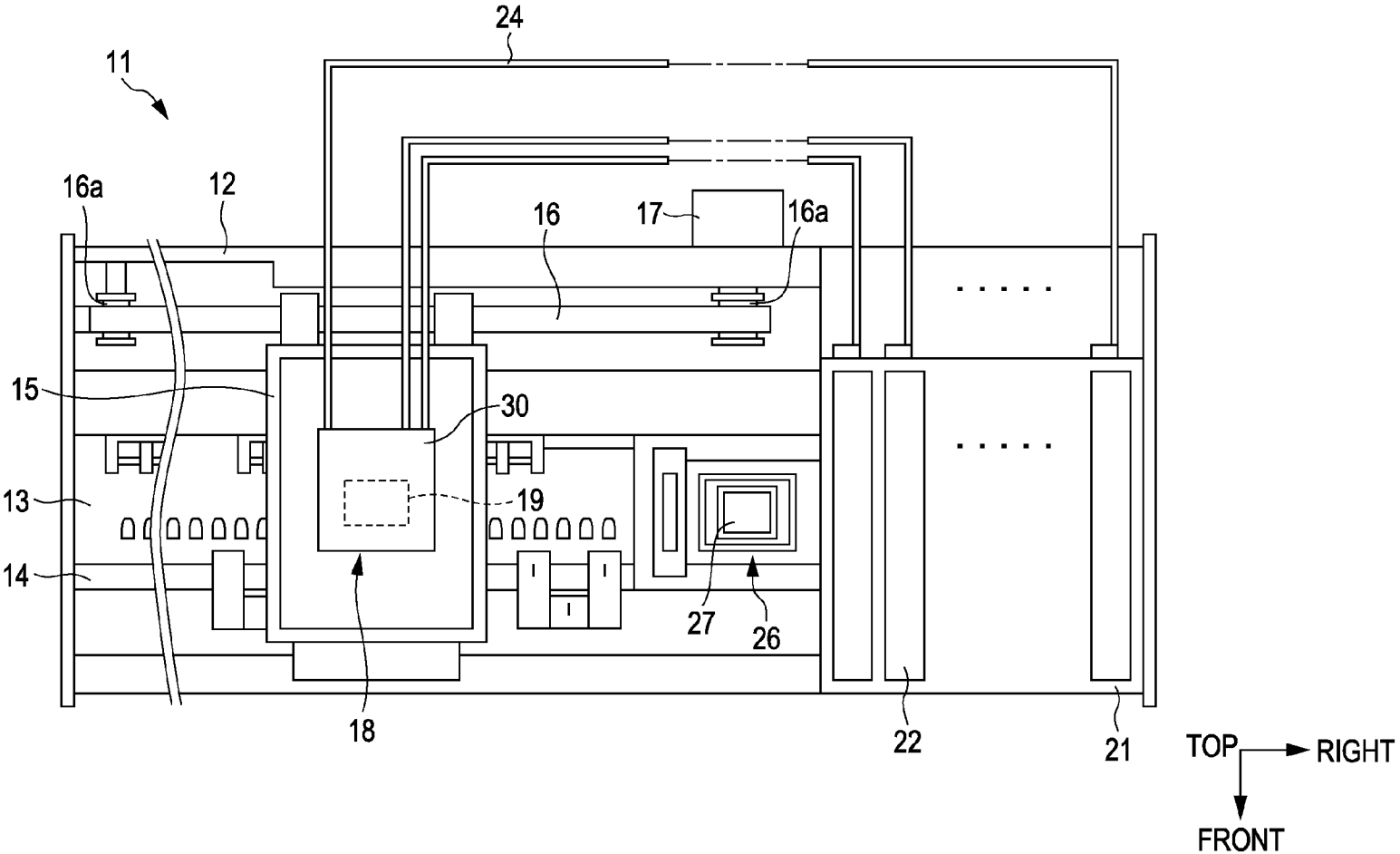
FIG. 1 is a plan view that schematically illustrates an example of the structure of a liquid ejecting apparatus according to a first embodiment of the invention.

As illustrated in FIG. 1, an ink-jet recording apparatus 11 is provided with a body frame 12 that has a rectangular shape in a plan view. The platen 13 extends inside the body frame 12 in the horizontal direction, which is a main scan direction. A paper-feed mechanism that is not illustrated in the drawing transports a sheet of recording paper (not illustrated) over the platen 13 from back to front, which is a sub scan direction. A guiding shaft 14 is provided inside the body frame 12 over the platen 13. The guiding shaft 14 extends in parallel with the direction of the length of the platen 13 (in the horizontal direction).

The guiding shaft 14 supports a carriage 15. The carriage 15 can reciprocate along the guiding shaft 14. An endless timing belt 16 is stretched between a pair of pulleys 16*a* that is provided on the inner surface of the rear wall of the body frame 12. The timing belt 16 is fixed to the carriage 15. The output shaft of a carriage motor 17, which is provided on the back of the body frame 12, is connected to one of the pair of pulleys 16*a*. Therefore, the carriage 15 is indirectly connected to the carriage motor 17. With the above structure, the carriage 15 reciprocates along the guiding shaft 14 when driven by the carriage motor 17.

An ink-jet recording head 18, which is an example of a liquid ejecting head, is fixed to the bottom of the carriage 15. The ink-jet recording head 18 and the platen 13 face each other. The ink-jet recording head 18 includes a head body 19 that ejects ink and an ink supply member 30 that supplies, to the head body 19, ink flowing from a plurality of ink cartridges 22 thereto. The ink supply member 30 is an example of a liquid supply member.

A plurality of nozzles (not shown) is formed in the lower surface of the head body 19. A piezoelectric element (not shown) that is provided inside the head body 19 is driven in order to eject ink from each of the nozzles. Discharged ink droplets land on the surface of a sheet of recording paper (not shown) that is being transported over the platen 13. The ink-jet recording apparatus 11 prints an image on the paper in this way.

A cartridge holder 21 is provided on a right end area inside the body frame 12. Each of the plurality of ink cartridges 22, which is an example of a liquid supply source, is detachably attached to the cartridge holder 21. In the present embodiment of the invention, ten ink cartridges 22 are detachably attached to the cartridge holder 21 (note that three ink cartridges only are illustrated in FIG. 1; the rest of them are not illustrated therein). Different types of ink (having colors different from one ink to another) are contained in the respective ink cartridges 22. The cartridge holder 21 is connected to the ink supply member 30 mounted on the carriage 15 through a plurality of ink supply tubes 24 (in the present embodiment of the invention, ten ink supply tubes 24; note that three ink supply tubes only are illustrated in FIG. 1; the rest of them are not illustrated therein).

In a state in which the ink cartridges 22 are detachably attached to the cartridge holder 21, each of the ink cartridges 22 is in fluid communication with the ink supply member 30 through the corresponding one of the plurality of ink supply tubes 24. The ink supply member 30 is configured to temporarily retain ink supplied from each of the plurality of ink cartridges 22 thereto through the corresponding one of the plurality of ink supply tubes 24 individually. The ink retained temporarily in the ink supply member 30 is then supplied to the head body 19 individually.

As illustrated in FIG. 1, a maintenance unit 26 is provided at the area of the home position of the carriage 15, which is an area near the right end area inside the body frame 12. The maintenance unit 26 is used for maintenance, for example, when the head body 19 is cleaned. The maintenance unit 26 includes a cap 27 and a suction pump (not shown). The cap 27 is a member that is brought into contact with the periphery of the lower surface of the head body 19 so as to enclose the nozzles of the head body 19. In addition, the cap 27 receives ink ejected from the openings of the nozzles during flushing operation. The suction pump is capable of applying a suction force to the inside of the cap 27.

So-called suction cleaning is carried out as follows. In a state in which the cap 27 is in contact with the periphery of the lower surface of the head body 19 and encloses the nozzles of the head body 19, the suction pump applies a suction force to the inside of the cap 27. Due to the suction force, ink with increased viscosity, air bubbles, and the like are forced out into the cap 27.

Figure 2:
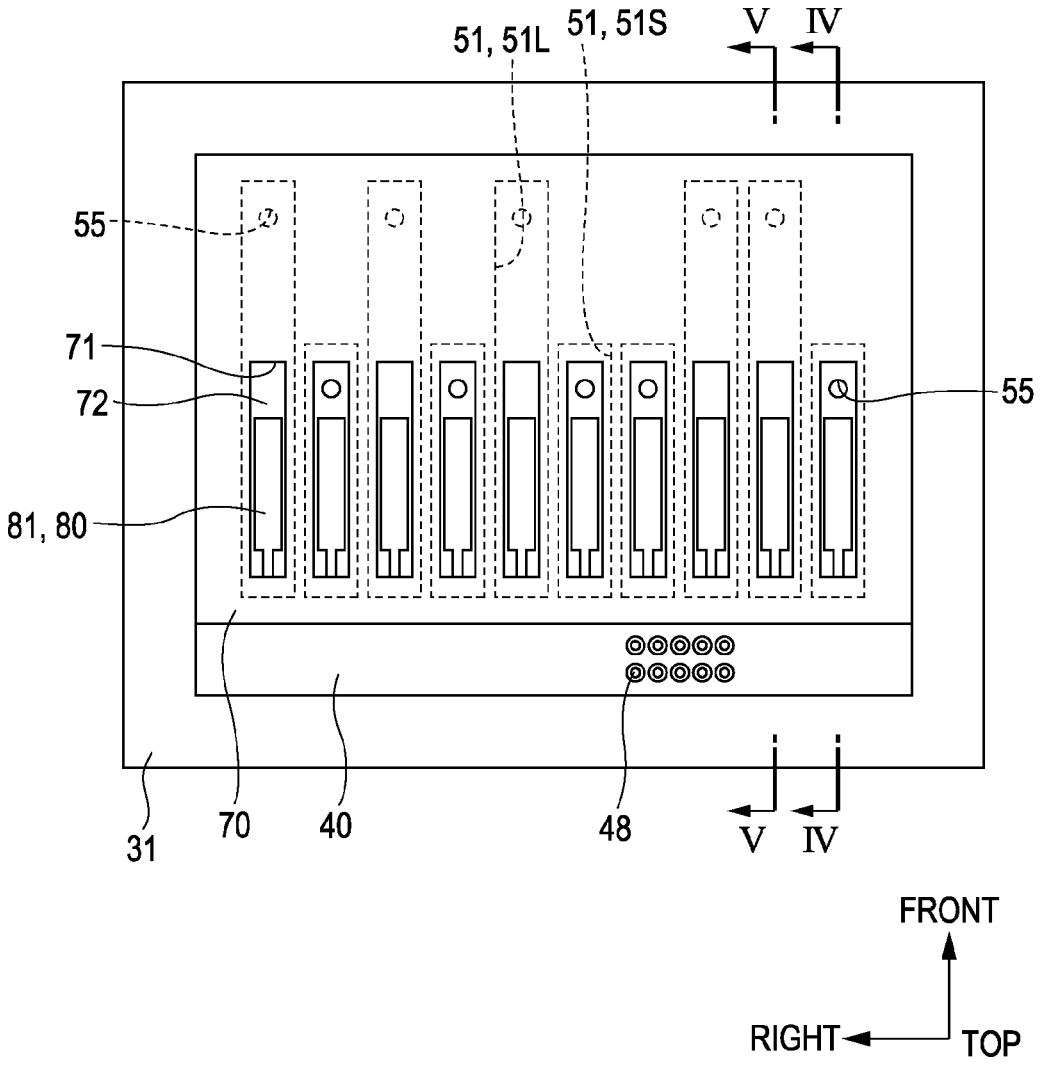
FIG. 2 is a plan view that schematically illustrates an example of the structure of an ink supply member according to the first embodiment of the invention.
Figure 3:
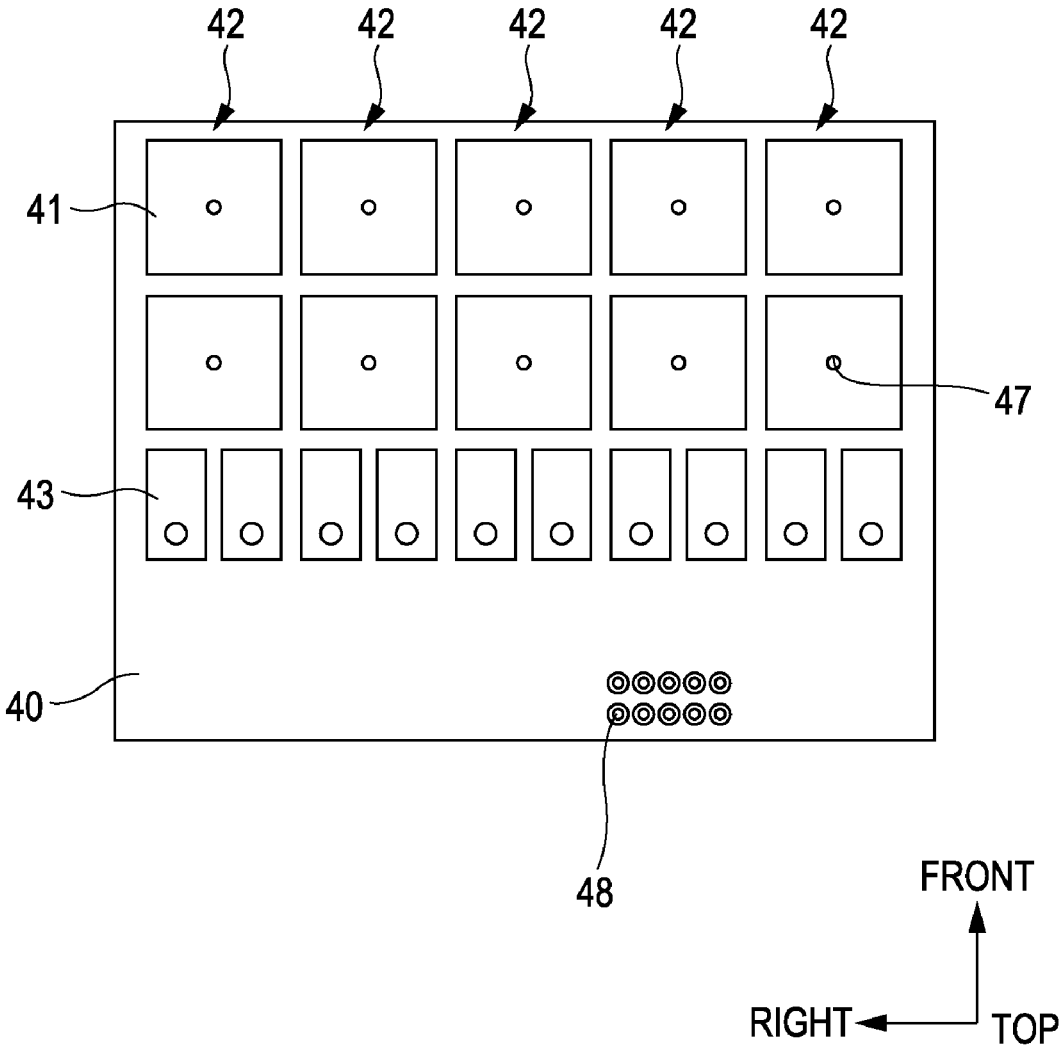
FIG. 3 is a plan view that schematically illustrates an example of the structure of a filter chamber formation member according to the first embodiment of the invention.
Figure 4:
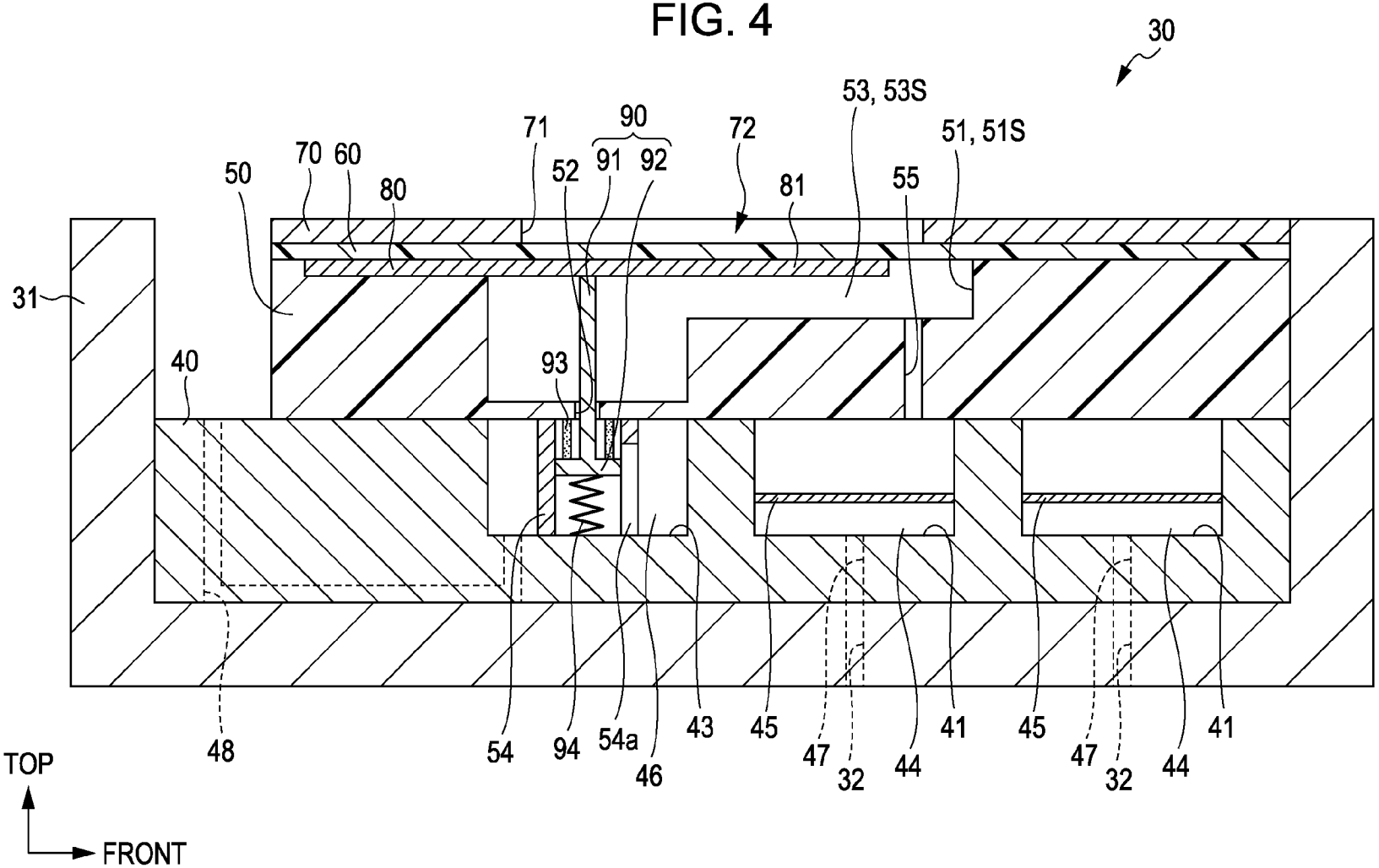
FIG. 4 is a sectional view of the ink supply member according to the first embodiment of the invention.
Figure 5:
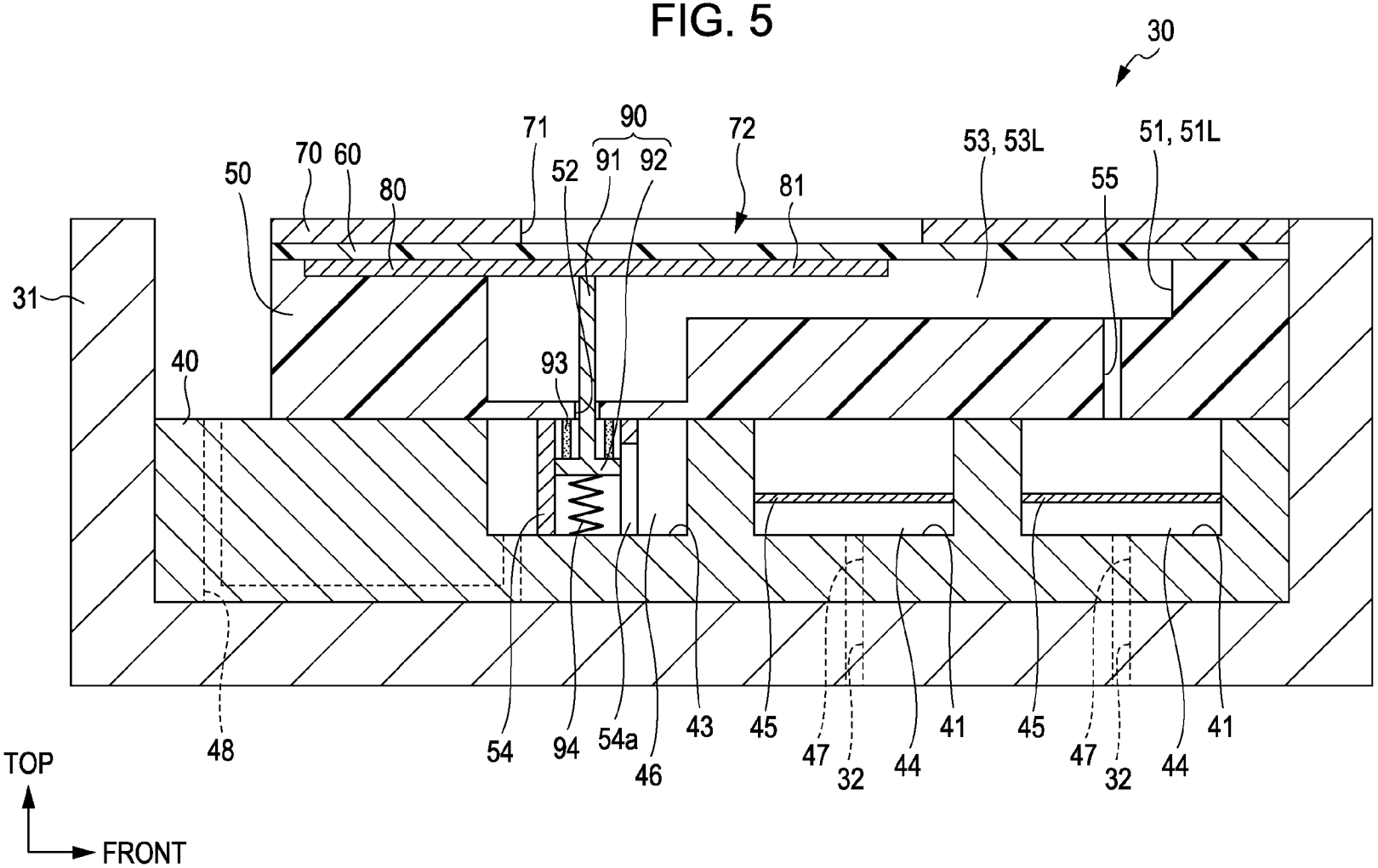
FIG. 5 is a sectional view of the ink supply member according to the first embodiment of the invention.

Next, the structure of the ink supply member 30 will now be explained in detail. FIG. 2 is a plan view that schematically illustrates an example of the structure of an ink supply member according to a first embodiment of the invention. FIG. 3 is a plan view that schematically illustrates an example of the structure of a filter chamber formation member according to the first embodiment of the invention. FIG. 4 is a sectional view taken along the line IV-IV in FIG. 2. FIG. 5 is a sectional view taken along the line V-V in FIG. 2.

As illustrated in these drawings, the ink supply member 30 includes a supporting member 31, which has the shape of an open-topped box with a bottom, and further includes a filter chamber formation member 40, a flow channel formation member 50, a flexible member 60, and a pressure reception portion formation plate 70 that are provided in layers. The filter chamber formation member 40 is provided on the inner bottom surface of the supporting member 31. The flow channel formation member 50 is provided on the upper surface of the filter chamber formation member 40. The flexible member 60 is provided on the upper surface of the flow channel formation member 50. The pressure reception portion formation plate 70, which has the shape of a flat plate, is provided on the upper surface of the flexible member 60.

The lower surface of the filter chamber formation member 40 is bonded to the inner bottom surface of the supporting member 31 by means of an adhesive. The lower surface of the flow channel formation member 50 is bonded to the upper surface of the filter chamber formation member 40 by means of an adhesive. The pressure reception portion formation plate 70 with the flexible member 60 deposited thereon is bonded to the upper surface of the flow channel formation member 50. The flexible member 60 is a member that is made of a flexible synthetic resin film. Each of the supporting member 31, the filter chamber formation member 40, and the flow channel formation member 50 is a rigid member. In addition, each of them is made of synthetic resin that is not permeable to liquid.

As illustrated in FIG. 3, a plurality of filter chamber concave portions 41 is formed in the upper surface of the filter chamber formation member 40. Specifically, a group of filter chamber concave portions 42, which is made up of more than one filter chamber concave portions 41 arranged in the forward/backward direction (one direction), is formed as cavities at areas in the neighborhood of or relatively close to the front of the filter chamber formation member 40. The bottom surface of the cavities is formed as one part of the inner bottom surface of the filter chamber formation member 40. Plural groups of filter chamber concave portions 42 are arranged next to one another in the horizontal direction. In the present embodiment of the invention, each of the plural groups of filter chamber concave portions 42 is made up of two filter chamber concave portions 41 arranged next to each other in the forward/backward direction. Five groups of filter chamber concave portions 42 are arranged next to one another in the horizontal direction. In other words, the filter chamber concave portions 41 are arranged in a matrix of two rows counted in the forward/backward direction and five columns counted in the horizontal direction at equal spaces in both of these two directions.

A plurality of valve member concave portions 43 is formed as cavities at areas relatively close to the back of the filter chamber formation member 40. The bottom surface of the cavities is formed as the other part of the inner bottom surface of the filter chamber formation member 40. The valve member concave portions 43 are arranged next to one another in the horizontal direction. A part of a valve member 90 is disposed inside the space of each of the valve member concave portions 43. The number of the valve member concave portions 43 formed for each of the groups of filter chamber concave portions 42 is the same as the number of the filter chamber concave portions 41 making up the group of filter chamber concave portions 42. In the present embodiment of the invention, two valve member concave portions 43 are formed for each of the groups of filter chamber concave portions 42. Therefore, ten valve member concave portions 43 in total are arranged next to one another in the horizontal direction. For each of the groups of filter chamber concave portions 42, the total width of two valve member concave portions 43 in the horizontal direction is approximately the same as the width of one filter chamber concave portion 41 in the horizontal direction. In addition, the width of one of the two valve member concave portions 43 in the horizontal direction is the same as the width of the other in the horizontal direction.

As illustrated in FIGS. 3, 4, and 5, ten spaces each of which is compartmentalized, that is, partitioned and demarcated, by the corresponding one of the filter chamber concave portions 41 and the flow channel formation member 50 are formed as filter chambers 44. A filter 45 is provided inside each of the ten filter chambers 44. Each of the filters 45 traps a foreign object or the like that is contained in ink that flows into the filter chamber 44 from the upstream side. Two filter chambers 44 that are compartmentalized by each of the groups of filter chamber concave portions 42 make up a group of filter chambers. In addition, ten spaces each of which is compartmentalized by the corresponding one of the valve member concave portions 43 and the flow channel formation member 50 are formed as valve member housing chambers 46. A part of the valve member 90, which opens and closes an inlet through which ink flows into a liquid flow channel (i.e., passage) 53, which will be described later, is disposed inside each of the valve member housing chambers 46.

The shape of the filter 45 in a plan view is approximately the same as the shape of the flow channel of the filter chamber concave portion 41 in a plan view. The filter 45 is disposed inside the filter chamber concave portion 41 in such a manner that its filtering surface traverses the vertical direction, that is, the direction of the flow of ink in the space of the filter chamber concave portion 41. The filter 45 may be made of metal that is woven into an ultra-fine mesh structure. Alternatively, for example, the filter 45 may be a metal plate having a number of minute holes, a non-woven fabric, or the like.

An outlet hole 47 is formed through the bottom surface of each of the plurality of filter chambers 44. Ink filtered through the filters 45 flows through the outlet holes 47 toward the head body 19, which is located at the downstream side. Each of the plurality of outlet holes 47 is in fluid communication with the corresponding one of a plurality of communication holes 32. The communication holes 32 are holes formed through the bottom of the supporting member 31. The filtered ink flows out through the outlet holes 47 and the communication holes 32 into the head body 19.

Besides the outlet holes 47, ink inlet channels 48 are formed in the filter chamber formation member 40. Ink supplied through the ink supply tubes 24 enters the ink inlet channels 48. One end of each of the plurality of ink inlet channels 48 is open at the upper surface of the filter chamber formation member 40. The other end thereof is open at the bottom surface of the valve member housing chamber 46.

As illustrated in FIGS. 2, 4, and 5, a plurality of flow channel groove portions 51, some (or one) of which have length different from that of the others or others (or the other or another), are formed in the upper surface of the flow channel formation member 50. Each of the plurality of flow channel groove portions 51 is elongated (i.e., extends) in the forward/backward direction. Herein, "some (or one) of the flow channel groove portions 51 have length different from that of the others or others (or the other or another)" means that the length of the flow channel groove portions 51 as viewed in its elongated direction is not identical one. Specifically, in the present embodiment of the invention, two types of flow channel groove portions 51 are formed in the upper surface of the flow channel formation member 50. The length of one of the two types of flow channel groove portions 51 is different from that of the other. The width of each of the one of the two types of flow channel groove portions 51 in the horizontal direction is the same as that of each of the other. The width of each of the flow channel groove portions 51 in the horizontal direction is approximately the same as that of each of the valve member concave portions 43 in the horizontal direction. Flow channel groove portions that are longer may be hereinafter referred to as flow channel groove portions 51L (a second flow channel groove portion). Flow channel groove portions that are shorter may be hereinafter referred to as flow channel groove portions 51S (a first flow channel groove portion).

The flow channel groove portion 51S extends from an area corresponding to that of the valve member housing chamber 46 of the flow channel formation member 50 to an area corresponding to that of the rear filter chamber 44, which is located closer to the back of the filter chamber formation member 40 as compared with the other of the two. The flow channel groove portion 51S is in fluid communication with the valve member housing chamber 46 at its rear region. A shaft insertion hole 52, which is a hole through which the shaft of the valve member 90 described later is inserted, is formed through the flow channel formation member 50 at the rear region. A communication hole 55 is formed through the flow channel formation member 50 at a front region of the flow channel groove portion 51S. The flow channel groove portion 51S is in fluid communication with the rear filter chamber 44 of the filter chamber formation member 40 through the communication hole 55.

In like manner, the flow channel groove portion 51L extends from an area corresponding to that of the valve member housing chamber 46 of the flow channel formation member 50 to an area corresponding to that of the front filter chamber 44, which is located in the neighborhood of the front of the filter chamber formation member 40. The flow channel groove portion 51L is in fluid communication with the valve member housing chamber 46 at its rear region. The shaft insertion hole 52, which is a hole through which the shaft of the valve member 90 described later is inserted, is formed through the flow channel formation member 50 at the rear region. The communication hole 55 is formed through the flow channel formation member 50 at a front region of the flow channel groove portion 51L. The flow channel groove portion 51L is in fluid communication with the front filter chamber 44 of the filter chamber formation member 40 through the communication hole 55.

The flow channel groove portions 51S and the flow channel groove portions 51L are arranged next to one another in the horizontal direction with their rear ends aligned in a plan view.

As described earlier, the flexible member 60, which is a member that is made of a flexible synthetic resin film, is provided on the upper surface of the flow channel formation member 50. The flexible member 60 seals the opening of each of the plurality of flow channel groove portions 51 at its top. Spaces that are compartmentalized by the flow channel groove portions 51 and the flexible member 60 are formed as the liquid flow channels 53. Spaces that are compartmentalized by the flow channel groove portions 51L and the flexible member 60 may be hereinafter referred to as liquid flow channels 53L. Spaces that are compartmentalized by the flow channel groove portions 51S and the flexible member 60 may be hereinafter referred to as liquid flow channels 53S.

In the present embodiment of the invention, the flexible member 60 is a single sheet of film that covers the upper surface of the flow channel formation member 50 entirely. One surface of the flexible member 60 is deposited on the pressure reception portion formation plate 70. The other surface of the flexible member 60 is bonded to the upper surface of the flow channel formation member 50 by means of an adhesive. The flexible member 60 may be provided for each of the plurality of flow channel groove portions 51 as individual flexible members.

The pressure reception portion formation plate 70, which is a single thin plate that is made of stainless, is provided on the upper surface of the flexible member 60. A plurality of openings 71 is formed through the pressure reception portion formation plate 70. The opening 71 is formed for each of the plurality of liquid flow channels 53. Specifically, the area of each of the openings 71 of the pressure reception portion formation plate 70, which is provided on the upper surface of the flexible member 60, overlaps the area of the corresponding one of the liquid flow channels 53.

Since the pressure reception portion formation plate 70 provided on the upper surface of the flexible member 60 has the plurality of openings 71, a part of the upper surface of the flexible member 60 is exposed at the area of each of the openings 71. Each of the exposed parts of the flexible member 60 functions as a pressure reception portion 72. Each of the plurality of pressure reception portions 72 of the flexible member 60 behaves as its regional part that becomes elastically deformed depending on a difference between atmospheric pressure and the internal pressure of the liquid flow channel 53. When the internal pressure of the liquid flow channel 53 relative to atmospheric pressure is reduced to a negative pressure level, the pressure reception portion 72 sags, that is, changes its position due to elasticity, toward the liquid flow channel 53. The valve 90 opens and closes as a result of the sagging of the pressure reception portion 72. A more detailed explanation will be given later.

The openings 71 formed through the pressure reception portion formation plate 70 have a uniform shape in a plan view. Needless to say, the term "uniform shape" herein encompasses not only exactly the same shape but also substantially the same shape while tolerating some degree of difference in shape attributable to, for example, manufacturing error. Specifically, the size of each of the openings 71 of the pressure reception portion formation plate 70 is prescribed to fit the size of the flow channel groove portions 51S, which is the shorter one of the two types of the flow channel groove portions 51. That is, the opening 71 is slightly narrower than the flow channel groove portion 51 in the horizontal direction in a plan view. In addition, the opening 71 is slightly shorter than the flow channel groove portion 51S in the forward/backward direction in a plan view. The openings 71 are formed next to one another in the horizontal direction. Each of the plurality of openings 71 is formed at an area inside the area of the corresponding one of the plurality of flow channel groove portions 51 and thus overlaps the flow channel groove portion 51.

As described above, a part of the upper surface of the flexible member 60 that is exposed at the area of each of the openings 71 functions as the pressure reception portion 72. Therefore, the pressure reception portions 72 have a uniform shape in a plan view because of the sameness of the openings 71 in shape.

As described above, the shape of the opening 71 prescribes the shape of the pressure reception portion 72 irrespective of the difference between the length of the liquid flow channel 53S and the length of the liquid flow channel 53L, each of which overlaps the pressure reception portion 72. Therefore, as in the present embodiment of the invention, even when a structure in which the liquid flow channels 53S and the liquid flow channels 53L that have different lengths are in fluid communication with the filter chambers 44 arranged in a matrix having rows and columns in the forward/backward direction and the horizontal direction is adopted, it is possible to form the pressure reception portions 72 that have a uniform shape. That is, when designing the liquid flow channels 53S and the liquid flow channels 53L, it is not necessary to take the shape of the pressure reception portions 72 into consideration, which increases the freedom of design related to the shapes of the flow channels of the ink supply member 30 and the arrangement thereof.

Moreover, since the pressure reception portions 72 have a uniform shape, they have the same area size. Therefore, it is possible to substantially equalize atmospheric pressure applied to the pressure reception portions 72. The effects of the equalization of atmospheric pressure applied to the pressure reception portions 72 will be described later.

An actuator plate 80 is provided for each of the plurality of liquid flow channels 53 between the upper surface of the flow channel formation member 50 and the pressure reception portion formation plate 70 with the flexible member 60 deposited thereon. The actuator plate 80 is a single thin plate that is made of stainless. The actuator plate 80 has moderate elasticity. That is, the actuator plate 80 is slightly narrower than the liquid flow channel 53 in the horizontal direction in a plan view. In addition, the actuator plate 80 is slightly longer than the liquid flow channel 53 in the forward/backward direction in a plan view.

The actuator plate 80 overlaps the opening 71 of the pressure reception portion formation plate 70. One end part of the actuator plate 80 is sandwiched between the flow channel formation member 50 and the flexible member 60. A regional part of the actuator plate 80 functions as an operation portion 81. The operation portion 81 is a part that is disposed at an area substantially corresponding to that of the opening 71. The actuator plates 80 are arranged next to one another. Each of the actuator plates 80 is located inside the corresponding one of the plurality of openings 71 in a plan view.

The operation portion 81 is formed as a free end. The pressure reception portion 72 of the flexible member 60 is in contact with the operation portion 81 of the actuator plate 80. When the pressure reception portion 72 sags, that is, changes its position downward due to elasticity, the operation portion 81 of the actuator plate 80 is pressed toward the liquid flow channel 53. As a result, the operation portion 81 becomes elastically deformed toward the liquid flow channel 53.

As described above, in the present embodiment of the invention, the ink supply tube 24, the valve member housing chamber 46, the liquid flow channel 53, the communication hole 55, the filter chamber 44, the outlet hole 47, and the communication hole 32 make up each of a plurality of ink supply channels through which ink is supplied from the corresponding one of the plurality of ink cartridges 22 to the head body 19. The valve member 90, which can close the inlet of the liquid flow channel 53, is provided upstream of the liquid flow channel 53. In the present embodiment of the invention, a part of the valve member 90 is disposed inside the valve member housing chamber 46 as described below.

A case portion 54 is formed inside the valve member housing chamber 46 on the outer bottom surface of the flow channel formation member 50. The case portion 54 has the shape of a vertical cylinder. The lower surface of the case portion 54 is in contact with the bottom surface of the valve member housing chamber 46. A slit 54*a* through which the inner space of the case portion 54 is in fluid communication with the outer space thereof is formed at the front of the case portion 54. Therefore, the inner space of the case portion 54 is in fluid communication with the inner space of the valve member housing chamber 46.

The valve member 90 is provided partially inside the liquid flow channel 53 and partially inside the valve member housing chamber 46 across a part of the flow channel formation member 50 as a partition wall therebetween. The valve member 90 includes a valve shaft 91 that has the shape of a column and a flange portion 92 that has the shape of a disc. The valve shaft 91 is inserted through the insertion hole 52. The flange portion 92 is formed at the lower end of the valve shaft 91 inside the case portion 54. The flange portion 92 has an outside diameter that is larger than that of the valve shaft 91. The lower end of the valve shaft 91 is connected to the center of the upper surface of the flange portion 92. The upper end of the valve shaft 91 is in contact with the lower surface of the operation portion 81 of the actuator plate 80.

The outside diameter of the flange portion 92 is larger than the inside diameter of the insertion hole 52 and slightly smaller than the inside diameter of the case portion 54. A ring-shaped sealing member 93 that is made of a flexible material is fixed to the upper surface of the flange portion 92 along the rim of the upper surface. The sealing member 93 surrounds the valve shaft 91. The outside diameter of the sealing member 93 is approximately the same as the outside diameter of the flange portion 92. A coil spring 94, which is an example of an urging member, is provided between the lower surface of the flange portion 92 and the bottom surface of the valve member housing chamber 46 inside the case portion 54.

The coil spring 94 always urges the valve member 90 upward, which is the direction of closing the valve 90. When the valve member 90 is in a valve-closed state, the sealing member 93 is in tight contact with the ceiling of the case portion 54 in a state in which the insertion hole 52 is capped by the sealing member 93. In other words, when the valve 90 is not open, the inner space of the case portion 54 is not in fluid communication with the inner space of the liquid flow channel 53.

When the internal pressure of the liquid flow channel 53 is reduced to a negative pressure level as a result of the supplying of ink to the head body 19, the pressure reception portion 72 sags, that is, changes its position due to elasticity, toward the liquid flow channel 53 (downward) because of the difference between atmospheric pressure and the internal pressure of the liquid flow channel 53. Since the pressure reception portion 72 sags, the operation portion 81 of the actuator plate 80 becomes elastically deformed with downward deflection while hinging on the base end of the actuator plate 80.

In the process of the elastic deformation of the operation portion 81, the operation portion 81 presses the valve shaft 91 downward against the urging force of the coil spring 94, thereby moving the sealing member 93 away from the ceiling of the case portion 54 for unsealing. The valve 90 is opened in this way. When the valve member 90 is in a valve-open state, the insertion hole 52 is not in liquid-tight condition. In other words, when the valve 90 is open, the inner space of the case portion 54 is in fluid communication with the inner space of the liquid flow channel 53.

Next, the operation of the ink supply member 30 will now be explained in detail.

Each flow channel that includes the corresponding one of the plurality of liquid flow channels 53 and leads therefrom to the head body 19 is filled with ink at the time of initial filling or for replenishment after consumption during preceding ink-discharging operation. When the amount of ink retained in the liquid flow channel 53 is reduced as a result of ejection from the head body 19 in such an ink-filled state, negative pressure is generated inside the liquid flow channel 53. Therefore, the pressure reception portion 72 sags, that is, changes its position due to elasticity, toward the liquid flow channel 53 (downward) because of the difference between atmospheric pressure and the internal pressure of the liquid flow channel 53. Since the pressure reception portion 72 sags, each of the operation portions 81 of the actuator plates 80 becomes elastically deformed with downward deflection while hinging on the rear end of the actuator plate 80.

In the process of the elastic deformation of each of the operation portions 81, the operation portion 81 presses the valve shaft 91 downward against the urging force of the coil spring 94, thereby moving the sealing member 93 away from the ceiling of the case portion 46 for unsealing. The valve 90 is opened in this way. Since each of the valves 90 is opened, ink retained in the corresponding one of the plurality of valve member housing chambers 46 flows into the corresponding one of the plurality of liquid flow channels 53 through the corresponding one of the plurality of insertion holes 52. As a result of the replenishment of ink into each of the plurality of liquid flow channels 53, the negative pressure inside the liquid flow channel 53 is relieved. Therefore, both of the pressure reception portion 72 and the operation portion 81 return to their original positions, respectively. In addition, the valve 90 is closed due to the urging force of the coil spring 94. By this means, the internal pressure of each of the plurality of liquid flow channels 53 is always kept constant.

The replenished ink flows from the liquid flow channel 53 into the filter chamber 44 through the communication hole 55. The filter 45 provided inside the filter chamber 44 traps a foreign object or the like that is contained in ink. After filtration, the ink flows through the outlet hole 47 and the communication hole 32 into the head body 19.

As described earlier, the pressure reception portions 72 have a uniform shape in a plan view. Therefore, the pressure reception portions 72 have the same area size. Because of the same area size, atmospheric pressure applied to the pressure reception portions 72 is equalized. As a consequence of atmospheric pressure equalization, when the internal pressure of each of the liquid flow channels 53 is reduced to a negative pressure level due to consumption of ink, which is ejected from the head body 19, the difference between atmospheric pressure and the internal pressure of each of the liquid flow channels 53 is also equalized, which results in approximately the same amount of a change in the position of the pressure reception portion 72 due to elasticity. Therefore, it is possible to avoid a pressing force applied to each of the valve members 90 from varying from one to another.

Because of the equalization of a pressing force applied to each of the valve member 90 when the internal pressure of the corresponding one of the liquid flow channels 53 is reduced to a negative pressure level, it is possible to supply ink to the head body 19 with equal ink pressure, which does not differ from one liquid flow channel 53 to another.

As described above, in the ink-jet recording head 18 according to the present embodiment of the invention, the shape of the openings 71 of the pressure reception portion formation plate 70 prescribes the shape of the pressure reception portions 72 irrespective of the difference between the lengths of the liquid flow channels 53. Therefore, it is possible to ensure that the pressure reception portions 72 have substantially the same shape despite the fact that the liquid flow channels 53 have different lengths.

In the ink-jet recording head 18 according to the present embodiment of the invention, since the pressure reception portions 72 have a uniform shape and thus have the same area size, it is possible to substantially equalize atmospheric pressure applied to the pressure reception portions 72. Therefore, a pressing force applied to each of the valve members 90 does not differ from one to another. Thus, it is possible to supply ink to the head body 19 with equal pressure and thereby print an image having high quality while avoiding deterioration due to variation.

Second Embodiment

In the foregoing embodiment of the invention, the flexible member 60 is formed on and over the entire upper surface of the flow channel formation member 50 to seal the opening of each of the plurality of flow channel groove portions 51. However, the scope of the invention is not limited to such an exemplary structure. Since the shape of the openings 71 formed through the pressure reception portion formation plate 70 prescribes the shape of the pressure reception portions 72 irrespective of the difference in the shapes of the flow channel groove portions 51, for example, a liquid supply member according to an aspect of the invention may have a structure in which the lower surface of the pressure reception portion formation plate 70 is used to seal a part of the opening of each of the flow channel groove portions 51L.

Figure 6:
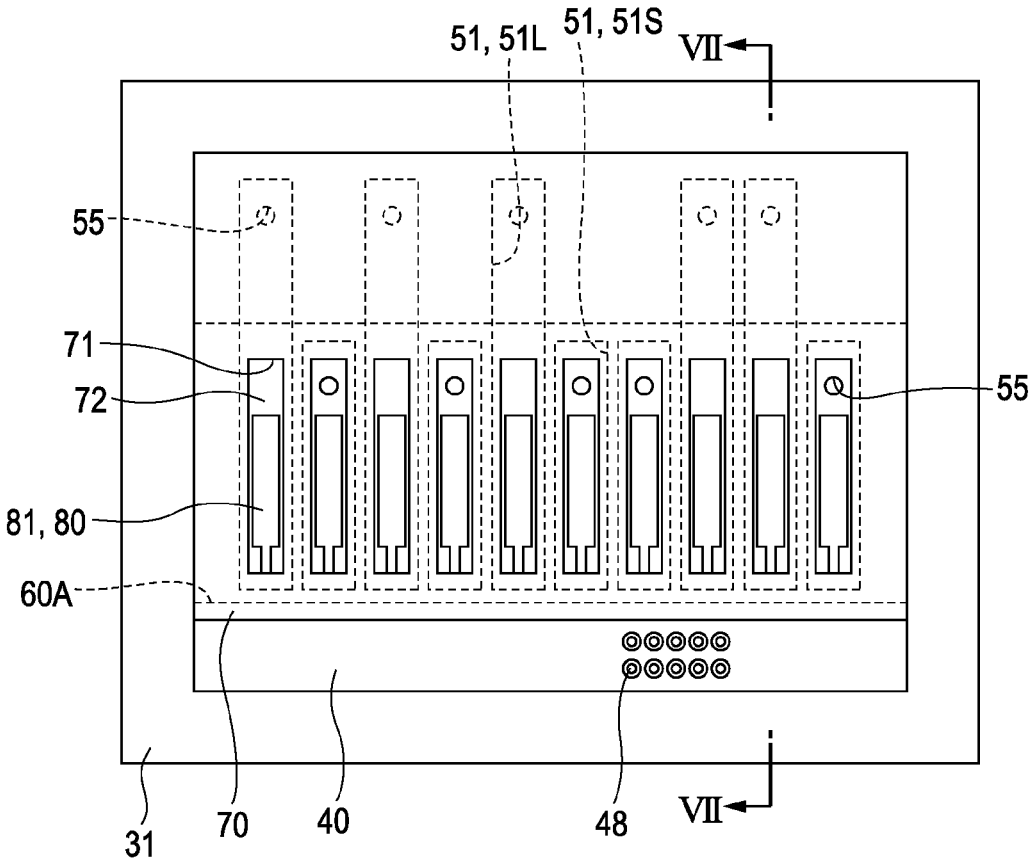
FIG. 6 is a plan view that schematically illustrates an example of the structure of an ink supply member according to a second embodiment of the invention.
Figure 7:
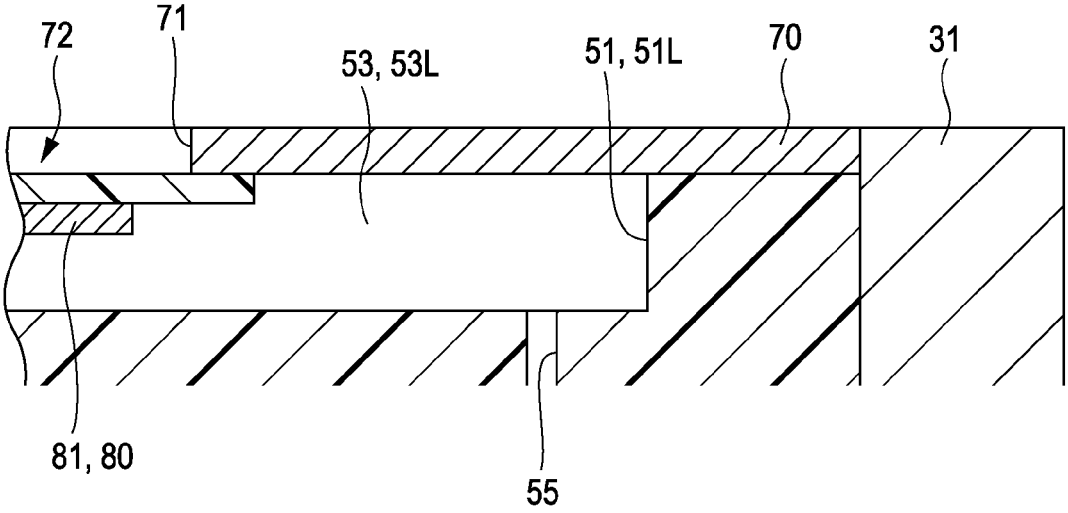
FIG. 7 is a sectional view that schematically illustrates, in an enlarged view, an example of the essential part of the ink supply member according to the second embodiment of the invention.

FIG. 6 is a plan view that schematically illustrates an example of the structure of an ink supply member according to a second embodiment of the invention. FIG. 7 is a sectional view taken along the line VII-VII in FIG. 6. The same reference numerals are assigned to the same constituent elements as those of the first embodiment of the invention to avoid redundancy in the following description.

As illustrated in FIGS. 6 and 7, as in the first embodiment of the invention, the size of each of the openings 71 of the pressure reception portion formation plate 70 is prescribed to fit the size of the flow channel groove portions 51S, which is the shorter one of the two types of the flow channel groove portions 51. That is, the opening 71 is slightly narrower than the flow channel groove portion 51 in the horizontal direction in a plan view. In addition, the opening 71 is slightly shorter than the flow channel groove portion 51S in the forward/backward direction in a plan view. The openings 71 are formed next to one another in the horizontal direction. Each of the plurality of openings 71 is formed at an area inside the area of the corresponding one of the plurality of flow channel groove portions 51 and thus overlaps the flow channel groove portion 51.

A flexible member 60A is formed over a part of the upper surface of the flow channel formation member 50. The width of the flexible member 60A in the horizontal direction is approximately the same as that of the flow channel formation member 50 in the horizontal direction. The flexible member 60A is slightly longer than the flow channel groove portion 51S in the forward/backward direction. The position of the rear edge of the flexible member 60A is prescribed in consideration of the position of the rear end of each of the plurality of flow channel groove portions 51 to make them fit.

It is the flexible member 60A only that seals the entire opening of each of the plurality of flow channel groove portions 51S. Each space that is compartmentalized by the flow channel groove portion 51S and the flexible member 60A is formed as the liquid flow channel 53S. On the other hand, the flexible member 60A seals a part of the opening of each of the plurality of flow channel groove portions 51L. It is the lower surface of the pressure reception portion formation plate 70 that seals the remaining part of the opening, which is not sealed by the flexible member 60A. That is, each of the plurality of liquid flow channels 53L is a space that is compartmentalized by the flow channel groove portion 51L, the flexible member 60A, and the pressure reception portion formation plate 70.

In addition, the communication hole 55 through which each of the liquid flow channels 53L is in fluid communication with the corresponding one of the filter chambers 44 is formed at a position in the area where the pressure reception portion formation plate 70 seals the remaining part of the opening of the flow channel groove portion 51L in a plan view.

Even in a case where the pressure reception portion 72 becomes elastically deformed and thus sags significantly inward, that is, toward the liquid flow channel 53L because of over-negative pressure or the like, there is no risk that the elastically deformed pressure reception portion 72 closes the communication hole 55 because, in place of the pressure reception portion 72 (the flexible member 60A), the pressure reception portion formation plate 70, which is rigid, is disposed over the communication hole 55. Since the closing of the communication hole 55 is avoided as described above, it is possible to prevent poor ink discharging. Thus, a liquid ejecting head with improved reliability is provided.

Another Embodiment

Although exemplary embodiments of the invention are explained above, needless to say, the scope of the invention is not limited to the specific embodiments described above. In the foregoing embodiments of the invention, the filter chambers 44 are formed in the filter chamber formation member 40. However, the scope of the invention is not limited to such an exemplary structure. For example, the filter chambers 44 may be formed in the flow channel formation member 50.

In the foregoing embodiment of the invention, plural groups of filter chamber concave portions 42 are arranged next to one another in the horizontal direction. Notwithstanding the foregoing, however, it suffices to provide at least one group of filter chamber concave portions 42 to produce the effects of an aspect of the invention.

In the foregoing embodiment of the invention, two types of the flow channel groove portions 51, that is, the flow channel groove portions 51L, which are longer, and the flow channel groove portions 51S, which are shorter, are formed in the upper surface of the flow channel formation member 50. However, the scope of the invention is not limited to such an exemplary structure. Three or more types of flow channel groove portions that have different lengths may be formed therein.

In the foregoing embodiment of the invention, an ink-jet recording head is taken as an example of a liquid ejecting head according to an aspect of the invention. The basic structure of the liquid ejecting head is not limited to the foregoing examples. The invention is directed to various kinds of liquid ejecting heads. Needless to say, the invention may be applied to a liquid ejecting head that ejects liquid other than ink. Liquid ejecting heads to which the invention is applicable encompass a wide variety of heads; specifically, they include without any limitation thereto: a variety of recording heads that are used in an image recording apparatus such as a printer or the like, a color material ejection head that is used in the production of color filters for a liquid crystal display device or the like, an electrode material ejection head that is used for the electrode formation of an organic EL display device, a field emission display device (FED), or the like, and a living organic material ejection head that is used for production of biochips.

What is claimed is:

1. A liquid ejecting head comprising:

a liquid ejecting head body that ejects liquid from a nozzle orifice; and a liquid supply member that supplies liquid from a liquid supply source that contains the liquid to the liquid ejecting head body, the liquid supply member including a filter chamber group that is made up of a plurality of filter chambers arranged in one direction, a filter being provided inside each of the filter chambers, each of the filter chambers being in fluid communication with the nozzle orifice, a flow channel formation member in which a plurality of flow channel groove portions is formed, each of the flow channel groove portions being in fluid communication with the corresponding one of the filter chambers of the filter chamber group, the flow channel groove portions having different lengths, a flexible member that seals an opening of each of the flow channel groove portions to form a liquid flow channel, a pressure reception portion formation plate that has an opening formed for each of the liquid flow channels, each of the openings overlapping the corresponding one of the liquid flow channels formed in the flow channel formation member with the flexible member sandwiched between the pressure reception portion formation plate and the flow channel formation member to form a pressure reception portion, which is a part of the flexible member that is exposed at an area of each of the openings, and valve members each of which is urged by an urging member to close the corresponding one of the liquid flow channels, the valve member opening the liquid flow channel against an urging force applied by the urging member as a result of a change in position of the pressure reception portion on the basis of a pressure change inside the liquid flow channel, wherein the openings of the pressure reception portion formation plate have a uniform shape.

2. The liquid ejecting head according to claim 1, each of the openings of the pressure reception portion formation plate being formed corresponding to an opening shape of a first flow channel groove portion, which has the shortest or a shorter length, further comprising:

a second flow channel groove portion that is sealed by the flexible member and the pressure reception portion formation plate, the second flow channel groove portion being longer than the first flow channel groove portion; and a communication hole through which the second flow channel groove portion is in fluid communication with the filter chamber, the communication hole being formed at a position in an area where the pressure reception portion formation plate seals the second flow channel groove portion.

3. A liquid ejecting apparatus that includes the liquid ejecting head according to claim 1.

* * * * *